US006289906B1

(12) United States Patent
Vanden Dries et al.

(10) Patent No.: US 6,289,906 B1
(45) Date of Patent: Sep. 18, 2001

(54) APPARATUS FOR HOLDING CONTACT LENS CARE COMPOSITION AND CONTACT LENS CASE

(75) Inventors: John W. Vanden Dries, San Juan Capistrano; Rodney J. Terwilliger, Jr., Buena Park, both of CA (US); William Gordon Beecroft, Leola, PA (US)

(73) Assignee: Allergan Sales, Inc., Irvine, CA (US)

( * ) Notice: Subject to any disclaimer, the term of this patent is extended or adjusted under 35 U.S.C. 154(b) by 0 days.

(21) Appl. No.: 09/267,987

(22) Filed: Mar. 12, 1999

(51) Int. Cl.[7] ..... B08B 3/04

(52) U.S. Cl. ..... 134/117; 134/901; 206/5.1; 215/6; 220/4.27

(58) Field of Search ..... 134/901, 117; 68/213; 206/5.1, 229; 220/41.26, 41.27; 215/6, 10; 422/292, 300

(56) References Cited

U.S. PATENT DOCUMENTS

| | | | | |
|---|---|---|---|---|
| D. 135,898 | | 6/1943 | Dawson . | |
| D. 208,166 | | 7/1967 | Hueber et al. . | |
| D. 246,896 | | 1/1978 | Plummer . | |
| D. 289,923 | | 5/1987 | Hoogesteger . | |
| D. 328,246 | | 7/1992 | Nottingham et al. . | |
| D. 362,390 | | 9/1995 | Weiler . | |
| D. 404,915 | | 2/1999 | Kornick et al. . | |
| D. 405,260 | | 2/1999 | Kornick et al. . | |
| 2,374,092 | | 4/1945 | Glaser . | |
| 2,690,861 | | 10/1954 | Tupper . | |
| 2,940,589 | | 6/1960 | Silverman . | |
| 3,252,492 | * | 5/1966 | Marchant | 215/10 X |
| 3,326,358 | | 6/1967 | Singleton . | |
| 3,877,598 | | 4/1975 | Hazard . | |
| 3,927,782 | * | 12/1975 | Edwards | 215/10 X |
| 4,002,275 | | 1/1977 | Crowle et al. . | |
| 4,235,343 | | 11/1980 | Thompson . | |
| 4,429,786 | | 2/1984 | Hucal . | |
| 4,700,729 | * | 10/1987 | Thaler | 134/901 X |
| 4,721,124 | * | 1/1988 | Tuerkheimer et al. | 134/901 X |
| 5,085,330 | * | 2/1992 | Paulin | 220/4.27 X |
| 5,129,520 | * | 7/1992 | Gaspar | 215/6 X |
| 5,186,317 | | 2/1993 | Ryder et al. . | |
| 5,211,299 | | 5/1993 | Manfredonia . | |
| 5,312,014 | * | 5/1994 | Hamlin | 215/6 X |
| 5,415,275 | | 5/1995 | Girimont . | |
| 5,647,481 | | 7/1997 | Hundertmark et al. . | |

FOREIGN PATENT DOCUMENTS

| | | | | |
|---|---|---|---|---|
| 2633907 | * | 1/1990 | (FR) | 215/6 |
| 821657 | | 11/1987 | (JP) . | |
| 88609 | | 10/1995 | (LU) . | |
| 9534231 | | 12/1995 | (WO) . | |

OTHER PUBLICATIONS

"Combination solution container/dispenser and contact lens storage case", Bausch and Lomb Incorporated, #72228, Feb. 18, 1993.

* cited by examiner

*Primary Examiner*—Philip R. Coe
(74) *Attorney, Agent, or Firm*—Stout, Uxa, Buyan & Mullins, LLP; Frank J. Uxa

(57) ABSTRACT

Apparatus comprising first and second containers for holding contact lens care compositions and contact lens cases, respectively. The first container defines a chamber adapted to hold contact lens care composition and has an outlet. The second container defines a compartment and is adapted to be removably secured to the first container such that the second container extends outwardly away from the first container with the second container removably secured to the first container. A closure assembly is preferably provided and is coupled to the outlet of the first container. The closure assembly includes a passageway in fluid communication with the outlet and is adapted to provide for egress of the contact lens care composition from the chamber. A cap member is adapted to be moved between an open position in which the passageway is open and a closed position in which the passageway is closed.

16 Claims, 3 Drawing Sheets

APPARATUS FOR HOLDING CONTACT LENS CARE COMPOSITION AND CONTACT LENS CASE

BACKGROUND OF THE INVENTION

The present invention relates to apparatus including two containers or container sections removably secured together. More particularly, the invention relates to such apparatus in which the first container holds material, such as a liquid contact lens care composition, for dispensing, and the second container defines a holding compartment, for example, holding a contact lens case in which the liquid composition can be used to treat contact lenses.

Contact lenses often require periodic treatment, for example, disinfecting, cleaning, soaking and the like, to provide substantial performance advantages. Such treatments often occur by immersing the lenses in a liquid contact lens care composition, for example, solution, in a contact lens case. Such cases can be used to store contact lenses between use periods. When it is desired to treat contact lenses, the appropriate contact lens care composition is removed from a bottle or container including the composition and passed into the contact lens case in which the contact lenses have been placed. After treatment, the contact lenses are ready for wear in the eyes of the user.

This relatively straightforward approach to caring for contact lenses does have certain drawbacks. For example, because the contact lens care composition and contact lens case are separate components, one of these components may become misplaced or otherwise unavailable. For example, in travel situations, the lens care composition or lens care case can quite easily be misplaced or not packed. Therefore, it would be beneficial to provide a system in which the lens care composition and lens case are stored together.

Combined lens care composition bottle and lens case systems have been suggested in the past. For example, bottles have been molded so as to provide a space in which the lens case can be received. However, the cost of manufacturing such prior combined systems has been relatively high. Also, such prior combined systems tend to be prone to separating the lens case from the lens care composition bottle, particularly during transit since the lens case can be relatively easily, and unintentionally removed from the lens care composition bottle.

SUMMARY OF THE INVENTION

New apparatus including containers, for example, containers for holding contact lens care compositions and contact lens cases, have been discovered. The present apparatus are straightforward in construction and require little, if any, complex manufacturing, particularly with regard to the lens care composition bottle. In addition, the containers are removably, yet positively, secured to each other, thereby reducing the risk that the lens case will be unintentionally separated from the lens care composition bottle. Additionally, the present invention is directed to an enhanced closure assembly which inhibits unwanted leaking of the lens care composition from the bottle.

In one broad aspect of the present invention, apparatus are provided which comprise a first container and a second container. The first container defines a chamber adapted to hold a material, for example, a liquid material, such as a liquid contact lens care composition. The first container has an outlet through which the material in the chamber passes in leaving the chamber. The second container defines a compartment and is adapted to be removably secured to the first container. The second container extends outwardly away from the first container with the second container removably secured to the first container. The compartment of the second container preferably is sized and adapted to hold a contact lens case.

The first container has a closed end, preferably located substantially opposite the outlet. The second container has an open end preferably positioned in close proximity to the closed end of the first container with the second container removably secured to the first container.

In a particularly useful embodiment, the second container is positioned and removably secured to the bottom of the first container and can be considered as a boot or base of the combined first and second container or bottle system. Thus, for example, the second container may be positioned in stacked relationship to the first container with the second container being positioned at the bottom of the system and the outlet of the first container being positioned substantially directly opposite the second container.

One important advantage of the present invention is that a contact lens case can be located in the compartment of the second container, rather than being directly attached to the first container. This reduces the risk of the lens case being unintentionally separated from the first container or lens care composition bottle. Because the first and second containers are positively secured together, accidental or unintentional separation of the first and second containers is relatively unlikely. Put another way, since a positive force, for example, manual force, is needed to disengage the two containers, the risk of unintentional separation is reduced.

The first and second containers can be removably secured together using any suitable coupling assembly. The coupling assembly chosen preferably is manually operable, that is the coupling assembly can be engaged or activated using manual force and/or can be disengaged or deactivated using manual force.

In one useful embodiment, the first container preferably includes an outer peripheral sidewall surface and the second container includes an inner peripheral sidewall surface which is structured to matingly engage the outer peripheral sidewall surface to removably secure the second container to the first container. More preferably, the first and second containers are structured to allow the engagement of the inner peripheral sidewall surface to the outer peripheral sidewall surface to be manually overcome. This feature is important since the removable securement of the first and second containers is maintained in the absence of manual force to avoid accidental separation, while being able to be manually overcome, when desired, so as to conveniently use the contents of the second container, for example, the lens case.

The first container preferably includes an outer peripheral surface and the second container includes an end peripheral surface adapted to substantially abut the outer peripheral surface of the first container. This feature effectively provides a substantially smooth transition between the first container and the second container which is beneficial, for example, for aesthetic purposes, and in addition is effective in maintaining the two containers removably secured together, thereby avoiding accidental or unintentional disengagement of the two containers.

In one very useful embodiment, the outer peripheral surface includes an indent near the second end of the first container. The inner peripheral sidewall surface of the second container includes at least one inwardly extending projection, and more preferably a plurality of spaced apart inwardly extending projections, adapted to be received and held in the indent of the outer peripheral surface to at least assist in removably securing the second container to the first container. The plurality of inwardly extending projections spaced apart from each other preferably are located at substantially the same distance from a closed end, for example, the bottom, of the second container.

The present apparatus preferably further comprises a closure assembly coupled to the outlet. The closure assembly includes a passageway in fluid communication with the outlet and is adapted to provide for egress of material, for example, the liquid contact lens care composition, from the chamber of the first container. A cap member is provided and is adapted to be moved between an open position in which the passageway is open and a closed position in which the passageway is closed.

In a particularly useful embodiment, the passageway is partially defined by a hollow projection and the cap member includes a cup structure positioned and adapted to receive the hollow projection when the cap member is in the closed position. The cup structure is separated from the hollow projection when the cap member is located in the open position. An elongate member preferably is provided fixedly secured to the cup structure. This elongate member extends into the passageway when the cap member is in the closed position. Having the elongate member extending into the passageway reduces the risk of unwanted leakage of the contents of the first container chamber with the cap member in the closed position.

The cup structure preferably has an open end into which the hollow projection passes as the hollow projection is received in the cup structure. This open end includes an inwardly extending rim which is adapted to assist in holding the hollow projection in the cup structure. This, again, reduces any unwanted leakage of the contents of the first container with the cap member is in the closed position.

The first and second containers can be made of any suitable material or combination of materials effective to meet the requirements of the application involved. In one very useful embodiment, the first container and the second container, as well as the closure assembly, are made of polymeric materials, more preferably thermoplastic polymeric materials. The first container preferably is sized to be held in one hand by a human adult and is squeezable, or sufficiently flexible, using manual force, to facilitate the removal of the material from the chamber of the first container.

In one particularly useful embodiment, the closure assembly preferably is a unitary component. That is, the closure assembly is produced as a single component or piece, for example, by polymeric material molding or other techniques, many of which are conventional and well known in the art.

In another broad aspect of the present invention, combinations comprising a first container, a liquid composition, a second container and a contact lens case are provided. The first container defines a chamber having an outlet. The liquid composition is located in the chamber and is effective in caring for contact lenses. The second container defines a compartment and is adapted to be removably secured to the first container. The second container extends outwardly away from the first container with the second container removably secured to the first container. The contact lens case is located in the compartment of the second container.

In one embodiment, the liquid composition preferably includes a disinfectant component in an amount effective to disinfect a contact lens immersed in a quantity of the liquid composition. One particularly useful example of the liquid composition is a multi-purpose contact lens care solution, which includes a non-oxidative disinfectant component and other functional components, such as surfactants, chelating agents, tonicity components, wetting agents, viscosity modifiers and the like, and is effective, for example, as a contact lens disinfectant, a contact lens cleaning composition, a contact lens soaking composition a contact lens rewetting composition and the like. A number of such compositions are known in the art. One specific example of such a multi-purpose contact lens care solution is the multi-purpose contact lens care solution sold by Allergan under the trademark Complete®.

The contact lens case preferably is adapted to hold two contact lenses immersed in a quantity of the liquid composition contained in the chamber of the first container.

In another broad aspect of the present invention, apparatus comprising a container and a closure assembly are provided. The container defines a chamber adapted to hold a material, for example, a liquid material, such as a liquid contact lens care composition. The container has an outlet. The closure assembly is coupled, preferably permanently secured, to the container and includes a hollow projection defining a passageway in fluid communication with the outlet and adapted to provide for egress of the material from the chamber. A cap member is included in the closure assembly and is adapted to be moved between an open position in which the passageway is open and a closed position in which the passageway is closed. The cap member includes a cup structure positioned and adapted to receive the hollow projection when the cap member is in the closed position, and to be separated from the hollow projection when the cap member is located in the open position. Each of the features discussed previously with regard to the closure assembly of the two container systems can be used in combination with this container/closure assembly aspect of the present invention.

Any and all features described herein and any and all combinations of such features are included within the scope of the present invention provided that the features of any such combination are not mutually inconsistent.

Additional aspects and advantages of the present invention are set forth in the following description and claims, particularly when considered in conjunction with the accompanying drawings in which like parts bear like reference numerals.

DETAILED DESCRIPTION OF THE DRAWINGS

The invention is described herein primarily in the context of contact lens care. This is an important application of the present invention. However, the invention is useful in other applications, particularly in applications in which a liquid or a fluid, for example, gaseous, vaporous, atomized powder and the like, composition is used in conjunction with one or more items which are ordinarily stored or transported separated from the compositions. Examples of such other applications include, but are not limited to, denture cleaning systems, adhesive systems, systems including a liquid and a tool or implement to apply or otherwise use the liquid, and the like. Each of these other applications is also included within the scope of the present invention.

Figure 1:
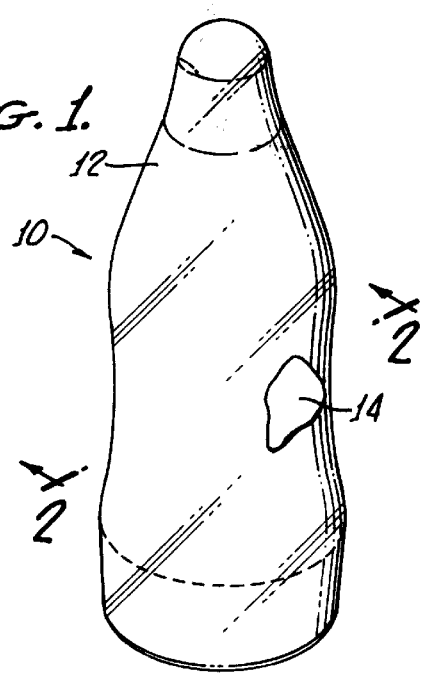
FIG. 1 is a front view, in perspective, of an apparatus in accordance with the present invention packaged for sale.

Referring now to FIG. 1, a combination bottle in accordance with the present invention, shown generally at 10 is packaged for sale in a plastic film sleeve 12. This sleeve 12 includes printed information regarding the product or products in bottle 10 and is sealed to provide a tamper-resistant package.

Figure 2:
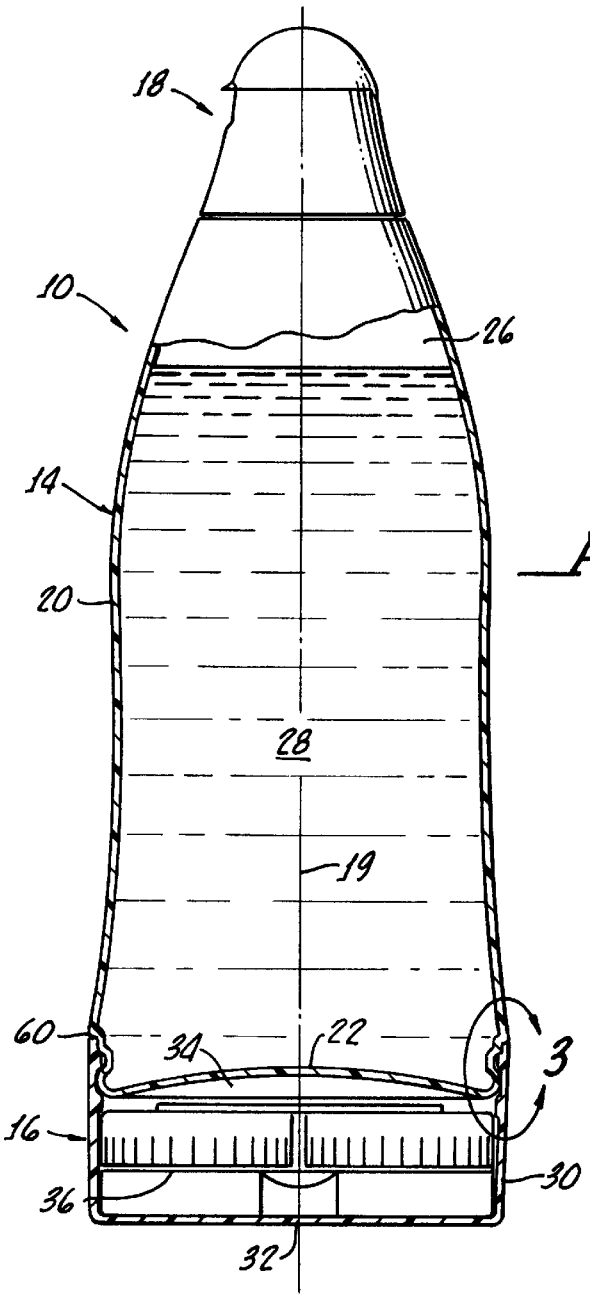
FIG. 2 is a front view, partly in cross-section, of the apparatus shown in FIG. 1 without the packaging.

With reference to FIG. 2, in which the sleeve 12 has been removed, bottle 10 includes a first container shown generally at 14, a second container shown generally at 16 and a closure assembly shown generally at 18.

Figure 4:
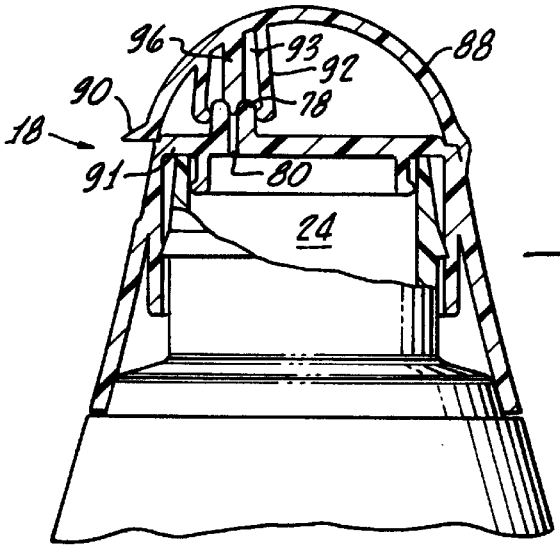
FIG. 4 is a partial front view of the apparatus shown in FIG. 1, partly in cross-section, with the cap member located in the closed position.
Figure 5:
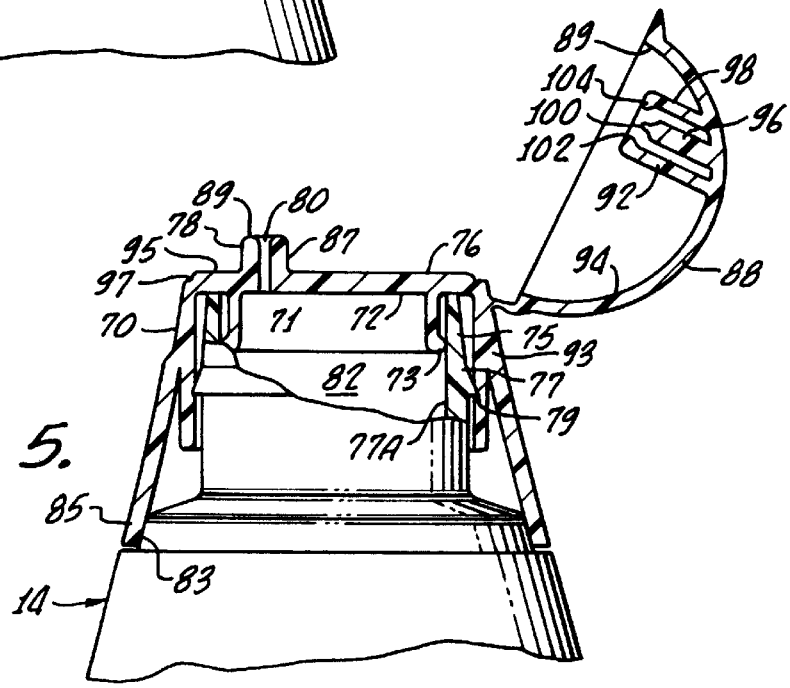
FIG. 5 is a partial front view of the apparatus shown in FIG. 1, partly in cross-section, with the cap member located in the open position.

First container 14 includes a peripheral sidewall 20, a closed bottom end 22 and an outlet 24, shown in FIGS. 4 and 5. First container 14 defines an internal chamber 26 in which is included a liquid multi-purpose contact lens care solution 28, such as the product sold by Allergan under the trademark Complete®. Of course, other contact lens care products can be used in chamber 26. Outlet 24 is in fluid communication with chamber 26. Liquid solution 28 passing out of first container 14 passes through outlet 24. First container 14 is made, e.g., molded, out of a thermoplastic polymeric material, such as, but not limited to, high density polyethylene, low density polyethylene, polypropylene, poly(ethylene terephthalate) and the like, and has sufficient flexibility to be manually squeezed to facilitate removing the liquid solution 28 from the chamber 26, as desired. First container 14 is sized so as to be held or gripped in one hand by a human adult. For example, the first container 14 has a length of about 5 inches to about 10 inches from bottom end 22 to the upper most end of outlet 24 and a width, or diameter, of about 2 inches to about 5 inches. As shown in the drawings, the diameter of first container 14 does vary slightly over the length of the first container.

The second container 16 includes a peripheral sidewall 30 and a closed bottom wall 32. As will be discussed hereinafter, the peripheral sidewall 30 defines an open top end 33 directly opposite bottom wall 32 of second container 16.

Second container 16 defines a holding compartment 34 in which is located a contact lens case 36 of conventional construction. Contact lens case 36 is adapted to hold two contact lenses separate from one another and to provide for a quantity of the solution 28 from chamber 26 to be introduced into the lens case 36 to immerse the contact lenses and treat the contact lenses. Second container 16 is made, e.g., molded, out of a thermoplastic polymeric material, such as, but not limited to, high density polyethylene, low density polyethylene, polypropylene, poly(ethylene terephthalate) and the like, and preferably has a length from closed bottom wall 32 to open top end 33 in the range of about 1 inch to about 3 inches, and a width or diameter in the range of about 2 inches to about 5 inches. The compartment 34 defined by the second container 16 is larger than is needed to carry lens case 36. Thus, compartment 34 can be used to carry other supplies, for example, other contact lens care supplies, such as contact lens cleaning enzyme tablets and the like, in addition to the lens case 36. This is a substantial advantage over the prior combined bottle systems in which only a lens case can be carried.

Although the shapes of both first container 14 and second container 16 shown in the drawings are generally circular cylinders, it should be understood that these containers can have any suitable shapes and be within the scope of the present invention. For example, rather than being generally circular in cross-section perpendicular to the longitudinal axis 19, as shown in the drawings, such cross-sections can be generally oval, rectangular, polygonal and the like.

Second container 16 may be considered a boot or a base of the combination bottle 10 and is removably secured to the first container 14. Although this removable securement can be accomplished using a variety of structures, the drawings show a very useful embodiment for such removable securement.

Figure 3:
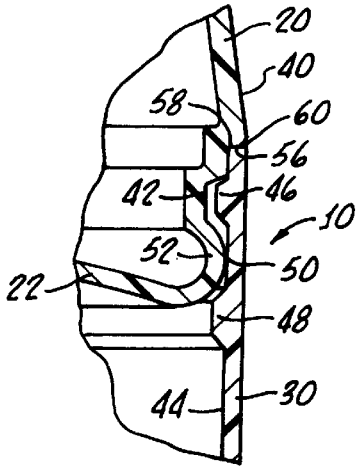
FIG. 3 is a cross-sectional view taken generally within arc 3 of FIG. 2.
Figure 6:
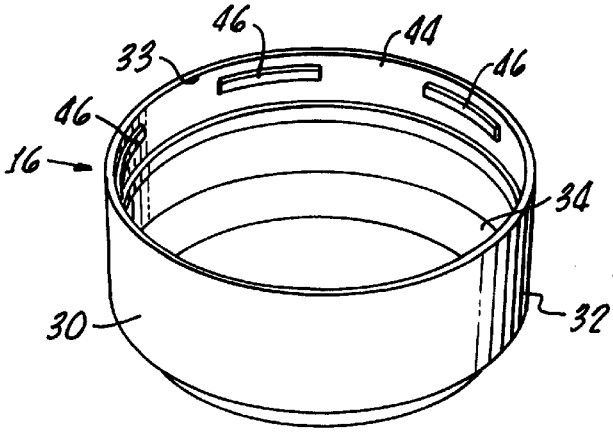
FIG. 6 is a top front view, in perspective, of the second container of the apparatus shown in FIG. 1.

With particular reference to FIG. 3, the outer peripheral surface 40 of peripheral sidewall 20 includes an indent 42. The inner peripheral surface 44 of peripheral sidewall 30 includes a series of spaced apart, inwardly extending projections 46 (FIG. 6) which are positioned so as to be received and held in indent 42, as shown in FIG. 3. The projections 46 are oriented substantially parallel to bottom wall 32 and at substantially equal distances from bottom wall 32. The peripheral sidewalls 20 and 30 have sufficient rigidity, such that once the projections 46 are placed in the indent 42 they remain in place until the engagement is disrupted, for example, by manual force.

In addition, inner peripheral surface 44 optionally includes an inwardly extending rib 48 which is spaced apart from the projections 46. The bottom most portion 52 of peripheral sidewall 20 extends outwardly from indent 42. This bottom most portion 52 is located in the space between the projections 46 and the rib 48 and contacts the inner peripheral wall 44 at region 50. This positioning of bottom most portion 52 between projections 46 and rib 48, as noted above, is effective in securing second container 16 to first container 14. Alternately, rib 48 can be removed and the inner peripheral wall 44 can be substantially straight (in profile) from the projections 46 downwardly. Bottom most portion 52 can be removed from this position using manual force.

The combinations of indent 42 and projections 46, and projections 46, and optionally rib 48, and bottom most portion 52 together are effective in removably securing second container 16 to first container 14.

In addition, the uppermost surface 56 of peripheral sidewall 30 is in abutting relation to the inwardly extending surface 58 of peripheral sidewall 20. When the second container 16 is secured to the first container 20, as shown in FIG. 3, this abutting relation provides for a substantially smooth transition between peripheral sidewall 20 and peripheral sidewall 30, for example, at periphery 60. This feature is effective to provide an aesthetically pleasing appearance to the apparatus 10 and, in addition, reduces the risk of unintentionally separating the second container 16 from the first container 14.

To overcome the securement of second container 16 to first container 14, the two containers are gripped by different hands of the user, for example, an adult human, and are gently turned (not rotated) relative to each other and/or are pulled apart. This is sufficient to remove the second container 16 from the first container 14.

Figure 7:
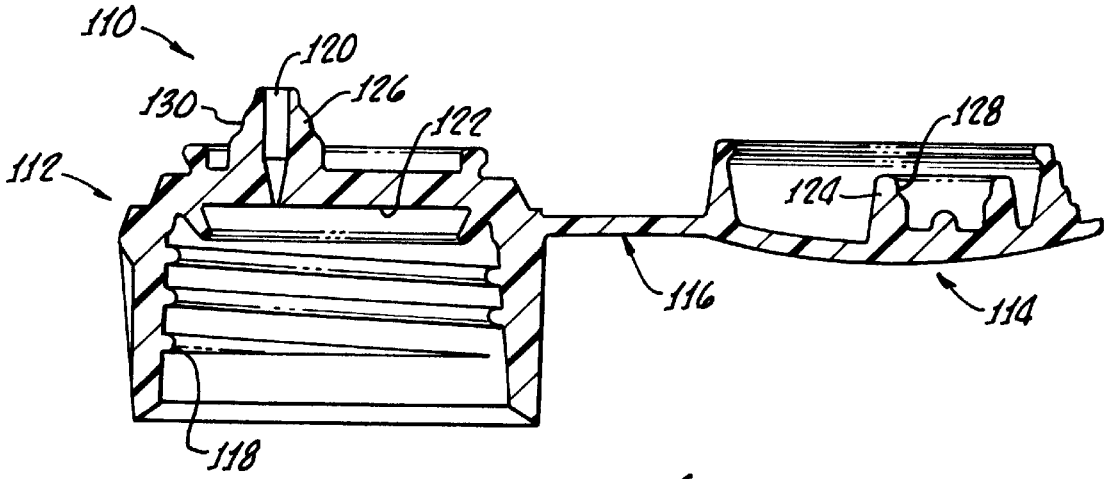
FIG. 7. PRIOR ART
FIG. 7 is a cross-sectional view of a prior art closure device with the cover separated from the body.
Figure 8:
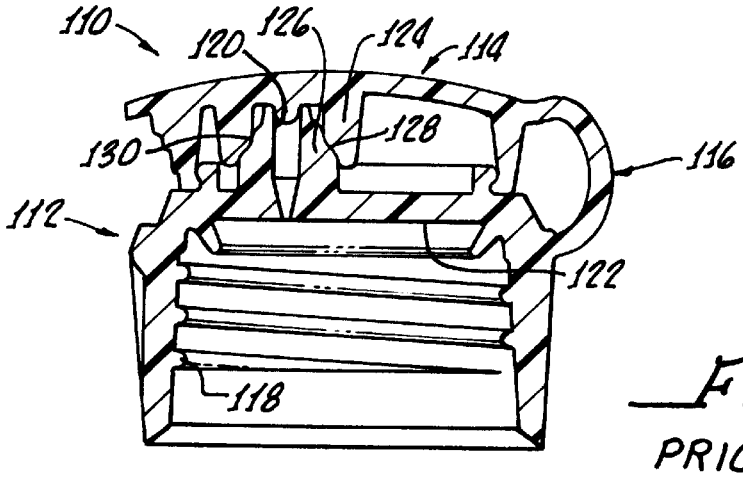
FIG. 8. PRIOR ART
FIG. 8 is a cross-sectional view of the prior art closure device shown in FIG. 7 with the cover coupled to the body.

Before discussing the closure assembly 18 of the present invention in detail, reference is made to FIGS. 7 and 8 which show a prior art closure device, shown generally at 110. This closure device 110 includes a body 112 and a removable cover 114 which is joined to the body by strip 116. Body 112 includes internal threads 118 to removably secure closure device 110 to a liquid-containing bottle, not shown. In addition, the liquid outlet passage 120 in body 110 is tapered downwardly toward wall 122. This tapering provides only a small opening for egress of the liquid from the bottle through the passage 120. Although this small opening may reduce the risk of liquid leakage, passing liquid out of the bottle is more difficult and time consuming. When the closure device 110 is closed, cover 114 is snap fit onto body 112 and receptacle 124 covers projection 126 which defines a part of liquid outlet passage 120. The lower inner sidewall 128 of receptacle 124 is structured to receive, in mating relation, the outer sidewall 130 of projection 126 when cover 114 is closed.

With regard to FIGS. 4 and 5, the closure assembly 18 is described in more detail. Thus, closure assembly 18 is fitted onto first container 14, for example, by interference fit, adhesives, and the like and combinations thereof. Preferably, no threads are used in securing closure assembly 18 to first container 14. Threadably securing the closure assembly to the first container can result in the closure assembly becoming loosened or separated from the container and the solution in the first container leaking or spilling out. The closure assembly 18 is preferably permanently secured to the first container 14, for example, so that such securement cannot be overcome by manual force. In this context, the term "permanently" means that the securement of the closure assembly 18 to the first container 14 cannot be overcome without destroying one or both of these components to at least the extent that the closure assembly and container cannot be resecured.

Closure assembly 18 includes a base 70 which includes a surface 72 in abutting relation to the top surface 74 of outlet section 75 of first container 14. Outlet 24 is defined by outlet section 75 of first container 14. The outer peripheral surface 77 of outlet section 75 includes a single outwardly extending projection 79 which circumscribes the outlet 24. This projection 79 is effective in holding the closure assembly 18 to the outlet section 75. The top wall 76 of base 70 includes a downwardly extending sealing ring 71 including an outwardly extending portion 73. Sealing ring 71 is positioned so that portion 73 comes in contact with and seals against inner peripheral wall 77A of outlet section 75. Thus, as the base 70 is placed over the outlet 24, the projection 79 comes in contact with the inner peripheral surface 81 of the base and portion 73 comes in contact with inner peripheral wall 77A. Such contact creates an interference or friction fit between the base 70 and the outlet section 75 and seals the outlet section 75 against unwanted liquid leakage. In addition, an adhesive can be used at the peripheral region 83 to secure the lower portion 85 of base 70 to the first container 14. In any event, closure assembly 18 is fixedly or permanently secured to the first container 14 and outlet section 75 is sealed against unwanted liquid leakage in a position as shown in FIGS. 4 and 5.

The top wall 76 of base 70 includes an upwardly extending, hollow projection 78, located off-center with respect to top wall 76, which defines a passageway 80 which is in fluid communication with the outlet 24. Passageway 80, which has a substantially constant cross-section, provides for egress of the solution 28 from first container 14. Cap member 88 is flexibly secured to base 70 by flexible strip 93 and can be flipped from the closed position, shown in FIG. 4 and the open position shown in FIG. 5. The open end 89 of cap member 88 is sized sufficiently large to receive the upper most portion 95 of base 70 when the cap member is in the closed position. A peripheral indent 97 is provided in top wall 76 so that the cap member 88 is positioned on top of base 70 and provides a smooth transition when the cap member is in the closed position. Element 90 on cap member 88 can be pushed upward by an adult human to move cap member 88 from the closed position to the open position. The cap member 88 can be manually moved from the open position to the closed position, as desired.

Cap member 88 includes a cup structure 92 extending downwardly from inner surface 94 of the cap member. An elongated finger-like projection 96 is centrally located within cup structure 92 which defines a hollow space 98.

The end portion 100 of finger-like projection 96 extending toward the open end 102 of cup structure 92 has a relatively reduced cross-section or diameter relative to the remainder of the finger-like projection 96.

In addition, the end 102 of cup structure 92 extending away from the cap member 88 includes an inwardly extending rim 104.

As shown in FIG. 4, when the cap member 88 is in the closed position, the hollow projection 78 is received within the hollow space 98 of cup structure 92. The end portion 100 of elongate projection 96 extends into the passageway 80. The inwardly extending rim 104 of cup structure 92, which has no corresponding or mating structure on outer sidewall 87 of projection 78, comes in gripping contact with the outer sidewall 87 of projection 78 and is effective in maintaining a sealing relationship between the elongate projection 96 and the passageway 80. Thus, the passageway 80 is effectively sealed against leakage of solution 28 from first container 14 when the cap member 88 is in the closed position. This seal is effective regardless of the orientation of the first container 14. This is particularly useful when the container is being used during travel or in other situations in which the orientation of the apparatus 10 is beyond the control of the user.

Combination bottle 10 may be used as follows. After bottle 10 is purchased, the packaging 12 is removed at least sufficiently to allow access to the closure assembly 18 and to the second container 16. When it is desired to treat contact lenses, the second container 16 is manually removed from the first container, as described above. The lens case 36 is removed from the second container 16. Contact lenses are placed in the lens case 36. The cap member 88 is moved from the closed position to the open position (FIG. 5). A quantity of solution 28 is caused to pass from outlet 24 through passage 80 into the compartments of the lens case 36. After a sufficient amount of solution 28 is placed in the lens case 36, the cap member 88 is returned to the closed position (FIG. 4). The lens case 36, containing the lenses, can then be placed back into the second container 16 and the second container can be resecured to the first container 14. Of course, the lens case 36 need not be located in the second container while the contact lenses are being treated. After a suitable period of time, that is a time sufficient to effect the desired treatment or treatments of the contact lenses in lens case 36, the second container 16 is again removed from the first container 14. The lenses are removed from the lens case and can be placed directly in the eye for safe and comfortable wear. The solution in the lens case 36 is removed. The lens case 36 is returned to the second container 16 and the second container is resecured to the first container 14, as described above.

The combination bottle 10 can be used repeatedly, as desired, to provide effective, periodic care of contact lenses. The combination bottle 10, with the second container 16 including the lens case 36 secured to the first container 14 and the cap member 88 in the closed position very effectively allows the transport of a contact lens care system in a single article.

While this invention has been described with respect to various specific examples and embodiments, it is to be understood that the invention is not limited thereto and that it can be variously practiced within the scope of the following claims.

What is claimed is:

1. An apparatus comprising:

a first container defining a chamber adapted to hold a material and having an outlet and completely closed end;

a contact lens care composition in the chamber;

a second container defining a compartment and adapted to be removably secured to the first container, the second container extending outwardly away from the first container with the second container removably secured to the first container, the second container having an open end positioned in close proximity to the completely closed end of the first container; and a contact lens holder located in the second container and being separate from the first and second containers.

2. The apparatus of claim 1 wherein the outlet is located at a first end of the first container and the second container is removably secured to the first container at or near an opposing second end of the first container which is the completely closed end.

3. The apparatus of claim 1 wherein the first container includes an outer peripheral surface and the second container includes an end peripheral surface adapted to substantially abut the outer peripheral surface of the first container.

4. The apparatus of claim 1 wherein the first container includes an outer peripheral sidewall surface and the second container includes an inner peripheral sidewall surface which is structured to matingly engage the outer peripheral sidewall surface to removably secure the second container to the first container.

5. The apparatus of claim 4 wherein the first and second containers are structured to allow the engagement of the inner peripheral sidewall surface to the outer peripheral sidewall surface to be manually overcome.

6. The apparatus of claim 4 wherein the outer peripheral sidewall surface includes an indent near the second end of the first container, and the inner peripheral sidewall surface includes an inwardly extending projection adapted to be received and held in the indent to at least assist in removably securing the second container to the first container.

7. The apparatus of claim 6 wherein the inner peripheral sidewall surface includes a plurality of the inwardly extending projections spaced apart from each other and located at substantially the same distance from a closed end of the second container.

8. The apparatus of claim 7 wherein the inner peripheral sidewall surface includes an inwardly extending rib spaced apart from the inwardly extending projections and located closer to a closed end of the second container than are the inwardly extending projections, and the outer peripheral sidewall surface includes an end region configured to contact the inner peripheral sidewall surface between the inwardly extending projections and the inwardly extending rib with the second container removably secured to the first container.

9. The apparatus of claim 1 which further comprises a closure assembly coupled to the outlet, the closure assembly includes a passageway in fluid communication with the outlet and adapted to provide for egress of material from the chamber, and a cap member adapted to be moved between an open position in which the passageway is open and a closed position in which the passageway is closed.

10. The apparatus of claim 9 wherein the passageway is partially defined by a hollow projection, and the cap member includes a cup structure positioned and adapted to receive the hollow projection when the cap member is in the closed position, and to be separated from the hollow projection when the cap member is located in the open position.

11. The apparatus of claim 10 which further comprises an elongate member fixedly secured in the cup structure and extending into the passageway when the cap member is in the closed position.

12. The apparatus of claim 1 wherein the first container is sized to be held in one hand by a human adult and is squeezable to facilitate the removal of the material from the first container.

13. A combination comprising:

a first container defining a chamber and having an outlet;

a liquid composition located in the chamber and being effective in caring for contact lenses;

a second container defining a compartment and adapted to be removably secured to the first container, the second container extending outwardly away from the first container with the second container removably secured to the first container;

a contact lens case located in the compartment and being separate from the first and second containers; and a closure assembly coupled to the outlet, the closure assembly includes a passageway in fluid communication with the outlet and adapted to provide for egress of the liquid composition from the chamber, and a cap member adapted to be moved between an open position in which the passageway is open and a closed position in which the passageway is closed.

14. The combination of claim 13 wherein the liquid composition includes a disinfectant component in an amount effective to disinfect a contact lens immersed in a quantity of the liquid composition.

15. The combination of claim 13 wherein the contact lens case is adapted to hold two contact lenses immersed in a quantity of the liquid composition.

16. An apparatus comprising:

a first container defining a chamber adapted to hold a material and having an outlet, a completely closed end and an outer peripheral sidewall surface including an indent near a second end of the first container;

a contact lens care composition in the chamber; and a second container defining a compartment and adapted to be removably secured to the first container, the second container extending outwardly away from the first container with the second container removably second to the first container, the second container having an open end positioned in close proximity to the completely closed end of the first container, the second container including an inner peripheral sidewall which is structured to matingly engage the outer peripheral sidewall surface to removably secure the second container to the first container, the inner peripheral sidewall surface includes a plurality of inwardly extending projections adapted to be received and held in the indent to at least assist in removably securing the second container to the first container, the projections being spaced apart from each other and located at substantially the same distance from a closed end of the second container, the inner peripheral sidewall surface includes an inwardly extending rib spaced apart from the inwardly extending projections and located closer to the closed end of the second container than the inwardly extending projections, and the outer peripheral sidewall surface includes an end region configured to contact the inner peripheral sidewall surface between the inwardly extending projections and the inwardly extending rib with the second container removably secured to the first container.

* * * * *